United States Patent [19]

Moyer

[11] 4,404,093

[45] Sep. 13, 1983

[54] AUTOMATIC WELL SKIMMER

[75] Inventor: Donald L. Moyer, Hummelstown, Pa.

[73] Assignee: R. E. Wright Associates, Inc., Middletown, Pa.

[21] Appl. No.: 386,346

[22] Filed: Jun. 8, 1982

[51] Int. Cl.[3] ..... B02B 15/08

[52] U.S. Cl. ..... 210/138; 210/143; 210/153; 210/923

[58] Field of Search ..... 210/110, 119, 122, 123, 210/138, 143, 153, 248, 533, 540, 923; 294/72; 166/53, 54, 69, 72, 73, 168

[56] References Cited

U.S. PATENT DOCUMENTS

| | | | |
|---|---|---|---|
| 94,475 | 9/1869 | Collins et al. | 294/72 |
| 373,266 | 11/1887 | Brown | 294/72 |
| 742,451 | 10/1903 | Ladley | 294/72 |
| 952,393 | 3/1910 | Whitehill | 294/72 |
| 984,656 | 2/1911 | Fleet | 294/72 |
| 1,350,348 | 8/1920 | Van Pelt | 294/72 |
| 1,358,357 | 11/1920 | Bewan | 294/72 |
| 1,629,912 | 5/1927 | Getz | 294/72 |
| 2,309,284 | 1/1943 | Thornley | 294/72 |
| 2,345,219 | 3/1944 | Sanderson | 166/69 |
| 2,593,830 | 4/1952 | Baker | 294/72 |
| 2,728,397 | 12/1955 | Ruska | 166/162 |
| 3,780,804 | 12/1973 | Pagel | 166/162 |
| 3,915,225 | 10/1975 | Swink | 166/53 |
| 4,086,035 | 4/1978 | Klaeger, Jr. et al. | 166/53 |
| 4,187,912 | 2/1980 | Cramer | 166/53 |
| 4,273,650 | 6/1981 | Solomon | 210/923 |

*Primary Examiner*—John Adee

*Attorney, Agent, or Firm*—Martin Fruitman

[57] ABSTRACT

An automatic well skimmer for removal of floating contaminates and oil and gasoline seepage from water wells. A cylindrical well bailer is lowered and raised by means of a motor driven cable hoist programmed to lower the bailer in small increments after detecting the liquid level and to lift the bailer before it is completely filled with liquid. When lifted to the surface the liquid is dumped from the bailer and the bailer is returned to the well. The timing of the controls can be varied to permit skimming at rates comparable to the seepage of hydrocarbons into the well and the bailer can be stored below ground in the well between cycles to prevent freezing of the unloading mechanism.

9 Claims, 3 Drawing Figures

AUTOMATIC WELL SKIMMER

SUMMARY OF THE INVENTION

This invention deals generally with wells and more specifically with an automatic bailer system for removing floating contaminates and hydrocarbons such as oil and gasoline from a water well.

There has been increasing public awareness of problems of oil and gasoline spills, not only in oceans, rivers and streams, but also above-ground spills and pipeline leaks, which has led to stringent government regulations to attempt to prevent longterm contamination of the environment by such spills. One such regulation deals with ground spills which cause the accumulation of oils or gasoline in deep wells used as water sources. The essential effect of that regulation is the prohibition of the accumulation of any detectable amount of oil, gasoline, or other hydrocarbon in such wells.

Some technical difficulties have arisen in the effort to meet this requirement because the conventional methods of removing liquids from wells by mechanical pumping are only satisfactory when large quantities of hydrocarbons are floating on top of the water in a well. In those cases a pump can be lowered into the well to the upper depths of the hydrocarbon and the contaminates simply pumped out. However, when the hydrocarbon quantity is small, such as in a well from which the gross contaminates have already been removed, or in a well where a relatively slow input flow of contaminates is occuring, the pump intake can not be located with enough precision to remove the hydrocarbons without pumping a great deal of water, and more important, without so thoroughly mixing the water and hydrocarbons that later separation is both difficult and costly. In the case of a well which has hydrocarbon depths of an inch or less floating on the water, it is virtually impossible to locate a pump intake accurately enough to remove anything other than water. This problem is further compounded in small diameter, deep wells which have an inherent limitation on the size of equipment that can be placed within them. Still further problems arise from the fact that the well depth at which the contaminates may be found can vary from day to day, since they float atop the water in the well which itself increases and decreases with ground water conditions. A system which is pumping oil one day could easily be pumping water the next as the ground water level increases.

Moreover, a conventional bottom loading, imprecisely positioned well bailer will merely remove water from below the hydrocarbon level, leaving the contaminates essentially intact.

The present invention overcomes the difficulty of removing small depths of hydrocarbons floating on top of a varying depth of water in a small diameter well by using a winch lowered, top loading, small diameter bailer to automatically sense the liquid level at each entry into the well and to skim only a limited amount of liquid, less than a full bailer load, on each trip out of the well. This is accomplished by the use sensitive weight sensing devices working in conjunction with a special timing system, both located above ground and actingupon the cable and the winch.

The automatic well skimmer of the present invention is based upon a motor driven winch which lowers and raises a cable into and out of a well. To the lower end of the cable is attached a simple cylindrical well bailer with an open top rather than the more conventional bottom located loading valve. The diameter of the cylinder is relatively small so that it can be lowered into even small diameter wells, and the depth of the well in which it can be used is limited only by the length of the cable available. The bailer also contains a simple mechanically actuated valve, at its lower end, which is used only above ground to unload the contents of the bailer after it is raised to the surface.

The motor, winch, and controls of the invention are all located above ground on a frame adjacent to the well head. A reversible motor is used to drive the winch drum upon which is wound the bailer cable. The cable is guided into the well by guide members on the frame and is also routed over a pulley mounted on a balance beam which activates several switches to control the motor action. The various positions of the balance beam, which depend upon the net weight of the bailer and the forces acting upon it, are used to differentiate the several conditions which exist to vary the liquid load of the bailer and, along with special timing circuits, to control the automatic operation of the skimmer.

For instance, as the bailer is being lowered into the well the counterbalance adjustment of the balance beam is such that it is in a neutral position and motor runs continuously, lowering the bailer until some change occurs. When the bailer reaches the liquid surface, regardless of at what depth that surface is, or where it was on the previous cycle of lowering, the reduced weight of the bailer due to flotation causes the balance beam pulley over which the cable runs to rise, activating a first switch.

This switch, acting through a control system, changes the lowering action of the motor from a continuous motion to one of short incremental steps, each step lowering the bailer within the liquid by a small fraction of the total length of the bailer cylinder. The incremental lowering steps are each separated by short pauses, and the effect within the well is to immerse the bailer deeper within the liquid by multiple short movements each move being a short distance relative to the overall length of the bailer cylinder. This mode continues until the open top of the cylinder is lowered just slightly below the top surface of the liquid in the well.

At this point the skimming action occurs and the upper surface of liquid in the well flows into the bailer. Regardless of the depth of oil or gasoline in the well it will be that contaminating liquid, floating on top of the water, which will first go into the bailer. If the hydrocarbon depth is large, the flow will be of only hydrocarbons, but if a mere film of oil is atop the water, that also flows into the bailer, along with some water. The difference between these two extremes is only dependent on how many times the bailer has been cycled into and out of the well or the amount of hydrocarbons in the well.

The bailer, however, continues to lower incrementally, after the first flow of liquid into it, until the weight of the combined bailer and the liquid fill is sufficient to cause the balance beam at the surface to tilt below its neutral position. This point is adjusted by the counterbalance spring to occur well before the bailer is full of liquid, because, if the bailer were to fill with liquid, the light hydrocarbons would float to the top and out into the well again. As the balance beam tilts downward it activates a second switch which initiates a control sequence that reverses the cable movement and raises the unfilled bailer to the surface.

Once at the surface, the bailer unloading sequence begins. First the bailer cylinder, once its bottom is clear of the well head, contacts a mechanical lever which rotates a trough into position under the bailer cylinder, then a rod protruding from the top of the bailer engages a stop causing the bottom valve of the bailer to open, emptying its contents into the trough below it for disposal into a separate container or water-oil separator apparatus.

Finally, with the cable still pulling the bailer up, the bailer itself engages a stop, causing the cable tension to increase and the balance beam to be pulled down to a second down position below the previous one. The balance beam, as it moves to this second down position activates a third switch which initiates a control sequence to stop the motor, and also reverses its direction of motion for when it restarts.

Also associated with the control system are several specific timers which are used to select one of several modes of operation for the automatic well skimmer to make it function in a variety of situations.

One of these modes is a system which repeats the sequence described above by beginning the lowering sequence after only a short time delay to permit emptying the bailer contents, thus furnishing continuous operation. This repeated skimming is needed for a well which has a large quantity or high input rate of hydrocarbons.

Another automatic mode of operation available is one in which a long interval timer is set to repeat a single operation of the skimmer at repeated time intervals, for instance, once an hour or once a day. This is used on wells which have a low input rate of hydrocarbons and the timer is set to operate the skimmer at intervals appropriate for the hydrocarbon flow into the well.

Another mode of operation available is the one for winter operation. For this operation, the control system is actually set for long interval repeat, but the system begins the repeat cycle after the bailer is emptied, and shuts down only after the bailer is lowered a suitable distance down into the well. This below ground storage of the bailer prevents the discharge valve and its operating rod from being impaired by freezing in cold weather.

Other features may also be incorporated into the control system to add greater versatility and prevent malfunctions. For instance, a well level control which prevents operation of the skimmer below a certain level of liquid in the well, and a safety control to remove the bailer from the well if it touches well bottom can be included.

The automatic well skimmer described is capable of unattended operation and satisfactorily attains the variable hydrocarbon removal rates required by most environmental regulations at low operating cost. Its highly reliable operation requires minimal maintenance, but, more important, it is capable of removing from wells hydrocarbon inflows which are so low that no other available apparatus can accomplish the task.

DETAILED DESCRIPTION OF THE INVENTION

Figure 1:
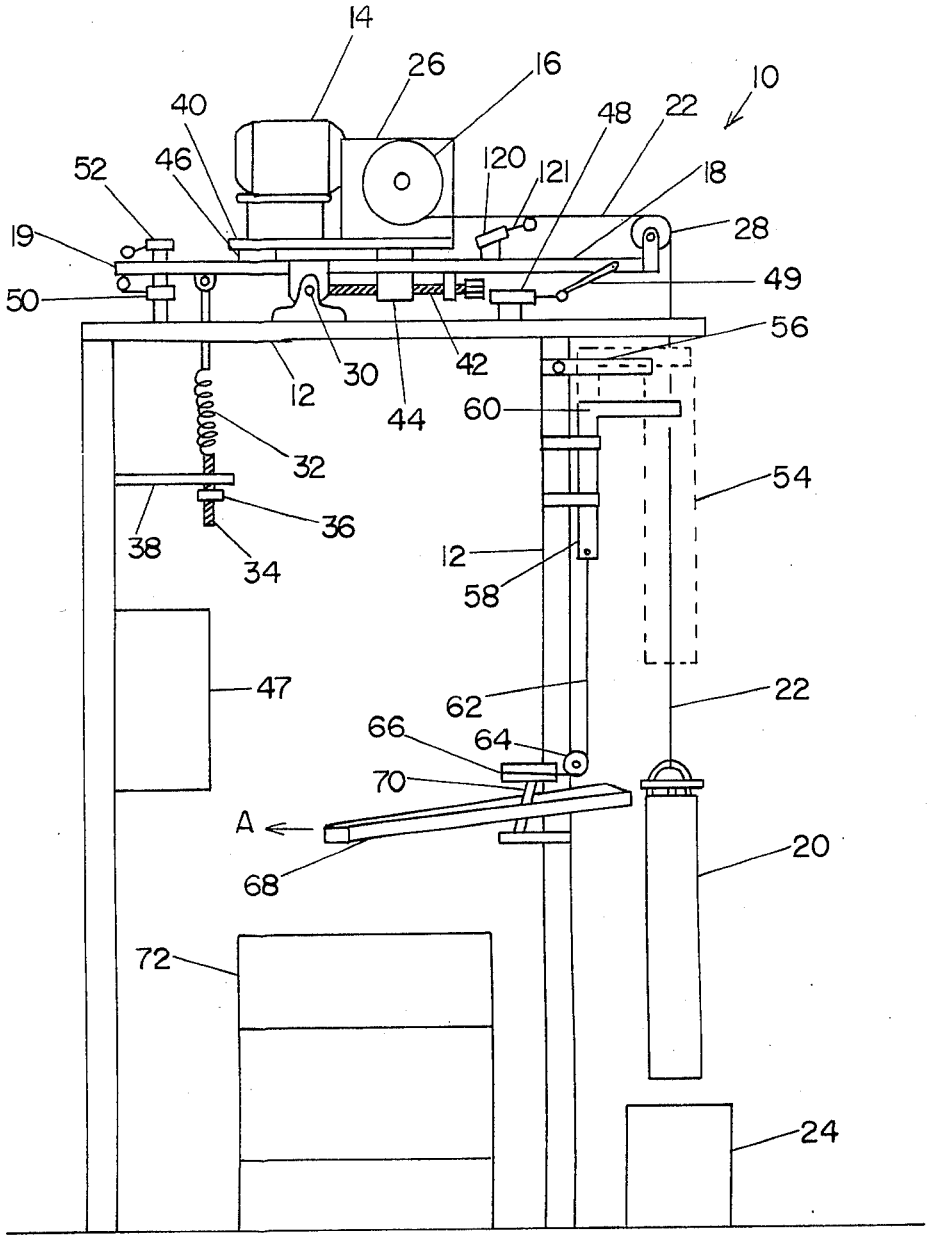
FIG. 1 is a side view of the preferred embodiment of the invention installed adjacent to a water well.

FIG. 1 depicts the preferred embodiment of the automatic well skimmer 10 in which frame 12 supports motor 14 and winch 16 which are mounted upon balance beam 18. Bailer 20 is attached by cable 22 to winch 16 which turns to wind cable 22 upon it or unwrap cable 22 from it in order to raise and lower bailer 20 into well 24. Motor 14 is attached to winch 16 by gearbox 26, or other appropriate drive means, and is reversible to permit both lowering and raising of bailer 20. Cable 22 is routed over pulley 28 on the end of balance beam 18 and hangs vertically downward from pulley 28 so that the weight of bailer 20 directly affects balance beam 18 without reduction due to directional vector components of the vertical force.

Balance beam 18 pivots upon fulcrum 30 and the sum of forces acting upon balance beam 18 is adjustable by the tension of spring 32, which is itself adjustable by threaded rod 34 and nut 36 anchored to frame 12 by stop 38. The balance of beam 18 is also adjustable by adjusting the horizontal location of platform 40, to which motor 14, gearbox 26, and winch 16 are attached. Platform 40 slides horizontally upon balance beam 18 on slides 46 due to rotation of threaded rod 42 which is threaded into fitting 44, attached to platform 40. These adjustments permit control of the quantity of liquid raised in each cycle.

The skimming action of the invention is essentially controlled by control system 47 and several limit switches which are activated by balance beam 18 as the dynamic forces upon it change due to changing forces upon bailer 20. Increased weight of bailer 20 causes pulley 28 to move downward and forces activating finger 49 attached to balance beam 18 against switch 48. Limit switch 48 is operated by finger 49 only if balance beam 18 has first moved upward to cock finger 49 by placing it above switch 48. Then, upon initial subsequent lowering of balance beam 18, finger 49 activates switch 49. Further lowering of balance beam 18 causes finger 49 to move past switch 48 and requires upward movement of finger 49 to cock it before switch 48 can be activated. This action assures that switch 48 will only be activated if bailer 20 first floats and then fills with liquid.

Limit switches 50 and 52 at the opposite end 19 of balance beam 18 act similarly, except limit switch 50 responds to a reduction of weight in bailer 20 which permits pulley 28 to rise as spring 32 pulls balance beam 18 down against limit switch 50. Limit switch 52 responds to extreme motion of pulley 28 downward which moves opposite end 19 of balance beam 18 upwards into contact with limit switch 52. This extreme motion is caused when bailer 20 is raised to its maximum height, as shown by phantom lines 54, and it hits stop 56, pulling pulley 28 downward as cable 22 is pulled tighter until motor 14 is stopped.

Limit switch 120 responds to cable slack and controls emergency reversal of motor 14 to lift bailer 20 by the action of cable 22 holding down arm 121 of switch 120. If cable 20 becomes slack and the cable tension is fully released, it no longer holds arm 121 downward and the internal spring in switch 120 causes arm 121 to move upward, activating switch 120.

Figure 3:
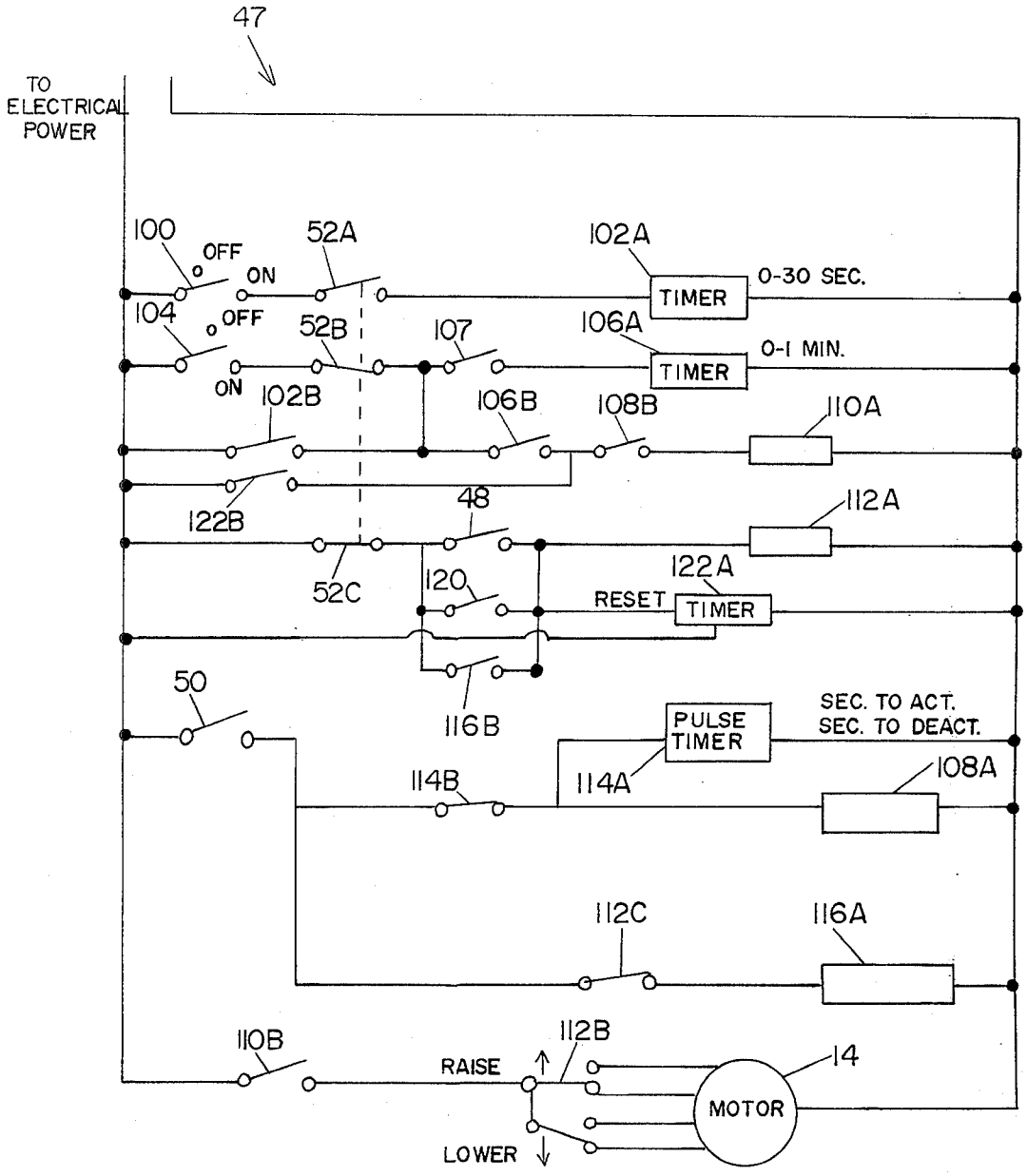
FIG. 3 is a simplified electrical diagram of the control system of the preferred embodiment.

The action of these various switches with control system 47 is fully described in conjunction with the description of FIG. 3.

The liquid unloading system of the preferred embodiment is also shown in FIG. 1. Rod 58 with cross arm 60 is pushed upward by bailer 20 as the bailer is pulled toward stop 56. Rod 58 thus pulls cable 62 which is routed over pulley 64 and wrapped around wheel 66. As wheel 66 turns because of the pull on cable 62, it also rotates trough 68, attached to it by axle 70, in direction A in the horizontal plane. This action rotates one end of trough 68 directly under bailer 20 after bailer 20 has risen above the horizontal plane of trough 68.

Figure 2:
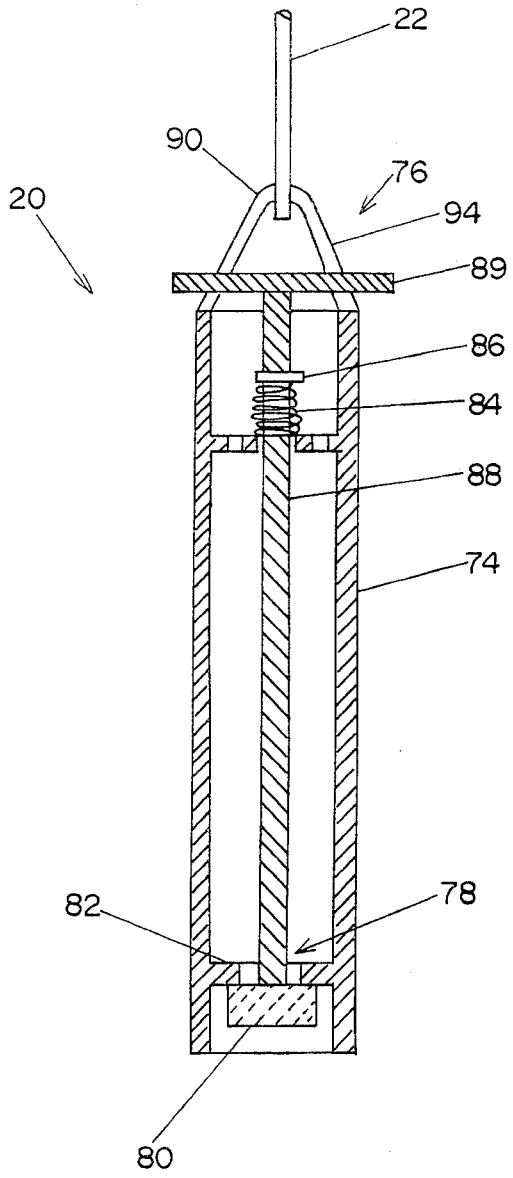
FIG. 2 is a cross-sectional view of the bailer of the preferred embodiment showing the valve action.

The contents of bailer 20 empty into trough 68 and then into container 72 as better described in reference to FIG. 2. Container 72 may be either a simple storage container or a tank supplying a conventional oil-water separator.

FIG. 2 is a cross sectional view of bailer 20 showing the valve structure for unloading. Bailer 20 is constructed essentially as a simple narrow cylinder 74 with an open top 76 and a hole 78 in the bottom. Hole 78 is closed off by stopper 80 which is retained against bottom 82 by the action of spring 84 held in place by retainer 86 on rod 88. Cable 22, used to raise and lower bailer 20 is attached to cylinder 74 by attachment rods 94. Rod 88 is centered in cylinder 74 by web 92.

In operation, top 90 of bailer 20 clears stop 56 (FIG. 1), but valve rod activator 89 hits stop 56. Cable 22 is further tightened by continued operation of motor 14 and winch 16 so that valve rod 88 and stopper 80 move downward against spring 84 and hole 78 in opened permitting any liquid in bailer 20 to drain out. As explained in reference to FIG. 1, control system 47 stops motor 14 only after the added tension on cable 22, caused after valve activator 89 moves against cylinder 74, has forced pulley 28 down, raising balance beam end 19 into contact with limit switch 52 and initiating the shut down of motor 14.

FIG. 3 is a simplified electrical diagram of control system 47 of the preferred embodiment of the invention which depicts the electrical action of limit switches 48, 50, 52 and 120 as they operate to control the direction and timing of motor 14.

For purposes of illustrating the skimmer action, assume the bailer is fully raised. It should be understood that the condition of all switches and relays in FIG. 3 are shown in their "normal" or "shelf" condition, with no electrical power or motivating forces applied. Thus, switches 48, 50 and 52 are shown unaffected by the balance beam. However, when the bailer is fully raised both switches 48 and 52, switch 52 having three sections 52A, B and C, are activated by force from the balance beam and are therefore actually in the opposite condition from that shown in FIG. 3. Also, for drawing clarity, relay and timer coils and contacts are separated on the diagram but identified by the same numerals and additional identifying letters.

Therefore, when switch 100 is set for continuous run by being manually turned on, switch 52A being closed, power will be applied to timer coil 102A which is set for a range of 0–30 seconds, essentially to permit time for the bailer to unload its contents. Switch 100 is used to activate the continuous run mode by powering timer coil 102A whose contact closes after the short 0–30 second time delay to initiate the lowering of the bailer.

Although switch 104, the on-off switch, has been manually turned on, since switch section 52B is open, power will actually be applied through timer contact 102B, normally closed timer contact 106B, and normally closed relay contact 108B to relay coil 110A. This closes relay contact 110B and powers motor 14, through the normally closed contacts of relay 112B, in the direction for lowering the bailer.

As the bailer 20 leaves stop 56, limit switch 52 changes to its normal condition (as shown) for all sections. Thus timer 102A is deactivated by switch section 52A, but switch section 52B closes, continuing to power relay coil 110A through switch 104 although contact 102B opens. Thus, motor 14 continues to lower until bailer 20 hits liquid in the well, causing it to float, releasing the weight on pulley 28, activating switch 50 my means of balance beam 18, and mechanically cocking switch 48.

Switch 50 applys power to pulse timer 114A and relay coil 108A. Relay contacts 108B therefore open, deactivating relay 110A, opening contacts 110B and stopping motor 14. Timer 114A, however, runs through its activating time delay and opens contact 114B deactivating both itself and relay 108A, starting motor 14 again, until contacts 114B close after the deactivating time of timer 114A. At that time, timer coil 114A is powered again and, after its activating time delay, motor 14 is stopped again.

This cycle repeats with each pulse of power, lowering bailer 20 into the well by a short distance which is determined by the timing of pulse timer 114A and the speed of motor 14.

The incremental lowering of bailer 20 continues until its top opening moves below the liquid level and the bailer takes on liquid. Significantly, the liquid flows into the bailer from the top of the liquid surface, thus preferentially filling the bailer with materials which are floating on top of the water in the well. Moreover, this filling will continue until the weight of the liquid in the bailer compensates for the reduction in weight due to flotation and then switch 48 will close as the balance beam tilts toward the bailer, activating arm 49 having been previously cocked by the flotation action.

When switch 48 closes, coil 112A activates to raise the bailer, 112C also opens, deactivating coil 116A, locking in relay coil 112A with contact 116B and assuring that the raising will continue regardless of the conditions of switches 48 and 50.

As explained previously, switch 120 is maintained open by tension on cable 22, and if the bailer should hit the bottom or hang up in the well as it lowers, switch 120 closes. This powers relay coil 112A and raises the bailer in the same manner as the operation of switch 48.

When bailer 20 reaches stop 56, limit switch 52 is activated, opening switch sections 52B and 52C to cut power to motor run relay 110A and motor raise relay 112A. At the same time switch section 52A closes, powering timer 102A to begin the entire sequence over after the time period of timer 102A has run.

Two other control features are also included in control system 47 to add versatility to the skimmer. Timer 122A can be set to repeat the skimming action only after a long delay, for instance, four hours. This type of operation is required for wells which have a slow inflow of hydrocarbons. With timer 122 set for the appropriate time of, for example, 4 hours, it actually begins its timing cycle when the power is applied to the circuit. However, timer 122 is reset to time zero through limit switch 52C and contact 116B each time the bailer begins to move up, and it begins timing again when limit switch 52C opens at the bailer full up position. If the continuous run mode is not in operation, that is, if timer 102A is not powered, the circuit will remain with the bailer in full up position until timer 122A runs its full time. Then contact 122B will close, providing power to motor run relay 110A and initiate the lower-raise sequence. Timer 122A will be reset as the bailer begins moving up after taking on liquid and its timing cycle will begin again as the bailer reaches the top. Timer 122A will therefore determine the repeat time of the skimming cycle.

Another feature which may be required when the skimmer is operated in the delayed repeat mode is the winter storage feature. This mode causes the bailer to be stored, not at its upper limit as would be more conventional, but within the well as it awaits the next repeat cycle. The storage within the well prevents bailer stopper 80 from freezing solid against bailer bottom 82 during extremely cold weather. This winter storage mode is initiated by manually activating switch 107 which powers timer coil 106A which runs for approximately one minute. This is sufficient time to lower the bailer into the well before contact 106B opens to deactivate coil 112A and stop motor 14.

Motor 14 will then be started again when delay timer 122A runs its full time and reactivates motor run relay 112A.

It is to be understood that the form of this invention as shown is merely a preferred embodiment. Various changes may be made in the function and arrangement of parts; equivalent means may be substituted for those illustrated and described; and certain features may be used independently from others wwithout departing from the spirit and scope of the invention as defined in the following claims.

For instance, other components such as semiconductor logic can be used to accomplish the same control functions, or more complex explosion proof relay systems may be used to replace the simple switch components described here. Moreover, the action of switches 48 and 50 could be combined into a single signaling means reacting to motion of the balance beam, if suitable logic were used, so that the incremental lowering begins upon reduction of weight and rising of the pulley end of the balance beam while raising of the bailer begins at subsequent lowering of the pulley end of the beam due to the force caused by increasing weight of the bailer. Furthermore, the location of the switches described may be varied from one side of the pivot to the other since both sides of the balance beam have the required motion.

What is claimed as new and desired to be secured by Letters Patent of the United State is:

1. An automatic well skimmer for removal of floating contaminates from water wells comprising:

a supporting structure adjacent to a well;

a horizontal balance beam mounted upon the supporting structure and pivoting upon a fulcrum;

a motor and a winch mounted upon the balance beam;

adjustment means attached to the balance beam and capable of compensating for forces acting upon the balance beam to attain a balance under a variety of force conditions;

a pulley attached to one end of the balance beam;

a cable wound upon the winch and routed over the pulley and vertically downward at the end of the balance beam;

an open top bailer attached to the end of the cable and including unloading means;

stop means attached to the supporting structure and engaging the bailer to prevent raising the bailer beyond a certain point;

first electrical signaling means mounted adjacent to and acted upon by the balance beam, providing a first electrical signal when the bailer weight is reduced by flotation within the well and a second electrical signal when the bailer weight is subsequently increased to a selected weight as liquid enters the bailer;

second electrical signaling means acted upon by the bailer and providing a third electrical signal when the bailer engages the stop means;

motor reversing means connected to the motor; and a control system, interconnected with the first electrical signaling means, the second electrical signaling means, the motor, and the motor reversing means, and comprising: first control means to initiate incremental lowering of the bailer within the well in increments which are a fraction of the total length of the bailer upon receiving the first electrical signal; second control means to reverse the motor and initiate raising the bailer to the surface upon receiving the second electrical signal; and third control means to initiate lowering of the bailer within a first preset time after receiving the third electrical signal.

2. The automatic well skimmer of claim 1 further including fourth control means within the control system to repeat individual cycles of bailer travel at a regular rate, with a second preset time interval between cycles.

3. The automatic well skimmer of claim 1 further including fifth control means within the control system to stop the bailer below ground level for storage between each cycle of bailer travel to prevent freezing of liquid in the bailer between cycles of bailer travel.

4. The automatic well skimmer of claim 1 further including adjustment means for modifying the balance of the balance beam for various forces acting upon it and to control quantity of liquid carried in each cycle.

5. The automatic well skimmer of claim 1 wherein the motor reversing means comprises an electrical means integral with the motor and a relay within the control system.

6. The automatic well skimmer of claim 1 wherein the first electrical signal means comprises two limit switches the first limit switch producing the first electrical signal when it is acted upon by the balance beam as the pulley end of the balance beam rises, and the second limit switch producing the second electrical signal when it is acted upon by the balance beam as the pulley end of the balance beam lowers only after the second limit switch is cocked by the previous raising of the pulley end of the balance beam.

7. The automatic well skimmer of claim 1 wherein the bailer unloading means comprises a vertically moveable rod which activates a valve in the bottom of the bailer when the rod is moved vertically relative to the bailer and; stop means to engage the vertical rod while permitting the bailer cylinder to move upward, opening the valve to empty the bailer contents.

8. The automatic well skimmer of claim 1 further including an unloading trough moved into position under the bailer, as the bailer approaches the top of its travel, by an activating rod attached to the supporting structure and located to engage the bailer and derive motion from the bailer.

9. The automatic well skimmer of claim 1 further including a cable tension sensing switch which activates the second control means to reverse the motor and initiate raising the bailer when the cable tension is fully released.

* * * * *